US005361911A

United States Patent [19]

Waites, Sr. et al.

[11] Patent Number: 5,361,911

[45] Date of Patent: Nov. 8, 1994

[54] SCREENING PANEL ATTACHMENT SYSTEM

[75] Inventors: Robert F. Waites, Sr., Moody; Robert F. Waites, Jr., Hoover, both of Ala.

[73] Assignee: Miller Wire Works, Inc., Birmingham, Ala.

[21] Appl. No.: 227,512

[22] Filed: Apr. 14, 1994

[51] Int. Cl.[5] ..... B07B 1/49

[52] U.S. Cl. ..... 209/399; 209/405; 209/403

[58] Field of Search ..... 209/399, 403, 405, 412

[56] References Cited

U.S. PATENT DOCUMENTS

| | | | |
|---|---|---|---|
| 3,456,795 | 7/1969 | Suensson et al. | 209/399 |
| 3,795,311 | 3/1974 | Martin | 209/399 X |
| 4,670,136 | 6/1987 | Schmidt et al. | 209/399 X |
| 4,871,288 | 10/1989 | Schmidt et al. | 209/399 X |
| 4,909,929 | 3/1990 | Tabor | 209/405 |
| 5,112,475 | 5/1992 | Henry, Jr. | 209/399 |
| 5,213,217 | 5/1993 | Galton et al. | 209/399 |

FOREIGN PATENT DOCUMENTS

| | | | |
|---|---|---|---|
| 80172 | 9/1992 | Australia . | |
| 567361 | 10/1993 | European Pat. Off. | 209/399 |
| 3606854 | 9/1987 | Germany | 209/399 |
| 73/5815 | 8/1975 | South Africa | 209/399 |

OTHER PUBLICATIONS

Connweld Industries, Inc. brochure Panelok (no date).
Bixby Zimmer Divsion brochure Pro-Deck (no date).
Isenmann America, Inc. brochure Modular System WS85 (Jun. 1989).
Norris Screen & Mfg., Inc. brochure Tabor-Thane System (no date).
Miller Wire Works, Inc. brochure (Jan. 1994).

*Primary Examiner*—D. Glenn Dayoan
*Attorney, Agent, or Firm*—Pettis & McDonald

[57] ABSTRACT

A device for removably attaching screening panels to the frame of a vibrating screen mechanism. The device has an elongate locking strip that is attached to the frame of the screen mechanism. An elongate projection extends upwardly from the locking strip and extends longitudinally the length of the locking strip. The projection has an enlarged first end that is received by an elongate wear pad between a pair of generally parallel, elongate, and flexible elements that extend generally the length of the pad. The enlarged end of the projection is received in the cavity defined by the elements. A portion of the periphery of a screening panel is captured between the pad and the frame. To obtain a positive locking attachment, the attaching device does not require special modifications to the standard screen edges or to most vibrating screen devices.

12 Claims, 5 Drawing Sheets

SCREENING PANEL ATTACHMENT SYSTEM

BACKGROUND OF THE INVENTION

1. Field Invention

The present invention relates to an attaching device for removably attaching screening panels to the frame of a vibrating screen mechanism. Once the attaching device of this invention is installed on an existing vibrating screen mechanism, the screens may be removably attached to the attaching device by a positive locking system that does not bolt the screens to the attaching device or to the frame. The attaching device does not require special modifications to standard screen edges.

2. Description of the Prior Art

Mechanisms that are used to sort materials by screening are well known in the art. Such mechanisms normally are comprised of a frame to which is mounted a series of screens that are held in place by various methods of attachment. The most common method of attachment is by bolting the individual screens to a longitudinal support frame or grid. Replacing installed screening panels to change the opening size of the screen or to replace damaged screens is a labor intensive activity due to the time required to remove and replace bolts.

Newer methods of attachment have been developed. One such method is illustrated by U.S. Pat. No. 5,112,475 issued to Henry. In this system the existing support beams or grid that directly support the screen panels on a vibrating screen mechanism are removed and new support beams are installed. The new beams have pre-drilled apertures for attachment of a locking system. The locking system comprises a longitudinal channel member that is interposed between two adjacent screen panels. The specially formed edges of the screens are locked into an adjacent one of the sides of the longitudinal channel member. A second longitudinal T-shaped locking member is inserted between the legs of the channel member forcing the legs outwardly so that they engage the edge of the screen and lock laterally together. This system requires the replacement of existing support structure in order to attach the locking device to an existing vibrating mechanism. The portion of the T-shaped locking member inserted in the U-shaped member has sloping sides that engage sloping sides on the U-shaped member, which does not provide a positive lock in the upward direction. This system relies upon the side to side squeezing action to create a lock between the U-shaped member and the specially formed edges of the screens. Thus, a lock is only possible utilizing screens that have the preformed edge, and a positive lock will not be created with standard profile wire screen panels. The U-shaped channel of this system will not readily accept bolts for attachment to an existing frame of a vibrating mechanism. As mentioned previously, existing portions of the frame must be removed and new ones installed.

Australian patent No. AU-A-80172/91 issued to Lettela Pty. Limited, discloses screens that have modified edges to provide a cooperable connecting means for attachment to a locking system. This locking system also requires modification of the existing vibrating mechanism and requires that the edges of the standard profile wire screen panels be modified.

Notwithstanding the existence of such prior art screening attachment systems, it remains clear that there is a need for an attaching system which may be installed on existing vibrating screen mechanisms with little modification and which can use existing screens without modification. Such a system must provide a positive downward lock to ensure that the screens do not become loose, but must permit quick and early installation and removal of the screens.

SUMMARY OF THE INVENTION

The present invention relates to a device that attaches portions of the periphery of an existing screening panel to the existing frame of a screening mechanism to permit easy removal and replacement of damaged screens or replacement of installed screens with screens having different screening characteristics. Most existing vibrating screen mechanisms comprise sides that have a screen attaching construction thereon, a frame that has at least one longitudinal C-channel and screens that are bolted to the C-channel. The current invention attaches an elongate locking strip to each channel by bolting or other attaching means. An elongate projection extends upwardly from the surface of the locking strip and extends generally throughout the length of the locking strip. The projection has a first end that is attached to the locking strip and a second end that extends away from the locking strip. The projection has a pair of opposing sides and an enlarged second end. The enlarged second end has two planar portions each extending at generally right angles from one of the opposing sides to form a pair of elongate shoulder.

The screening is installed between pairs of locking strips or between the side of the vibrating screen mechanism and a locking strip. A portion of the peripheral edge of the screening panel lies adjacent the projection.

The device further comprises an elongate wear pad that has a first surface with a pair of generally parallel elongate elements extending therefrom. A portion of each of the outwardly extending ends are angled at generally right angles to the portion of the element that is proximal to the first surface. The angled ends extend toward one another to form a pair of inwardly facing elongated ledges. The pair of elements define a cavity therebetween. The wear pad is attached to the locking strip by forcing the elongate projection into the cavity of the wear pad. The elements of the wear pad are flexible so that they move outwardly around the first end of the projection and spring back toward one another so that the ledge of the wear pad engages the shoulder on the projection. With the wear pad locked to the locking strip the portion of the periphery of the screening panel that is adjacent to the locking strip is now captured intermediate the first surface of the wear pad and the frame of the vibrating mechanism.

The invention accordingly comprises an article of manufacture possessing the features, properties, and the relation of elements that will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
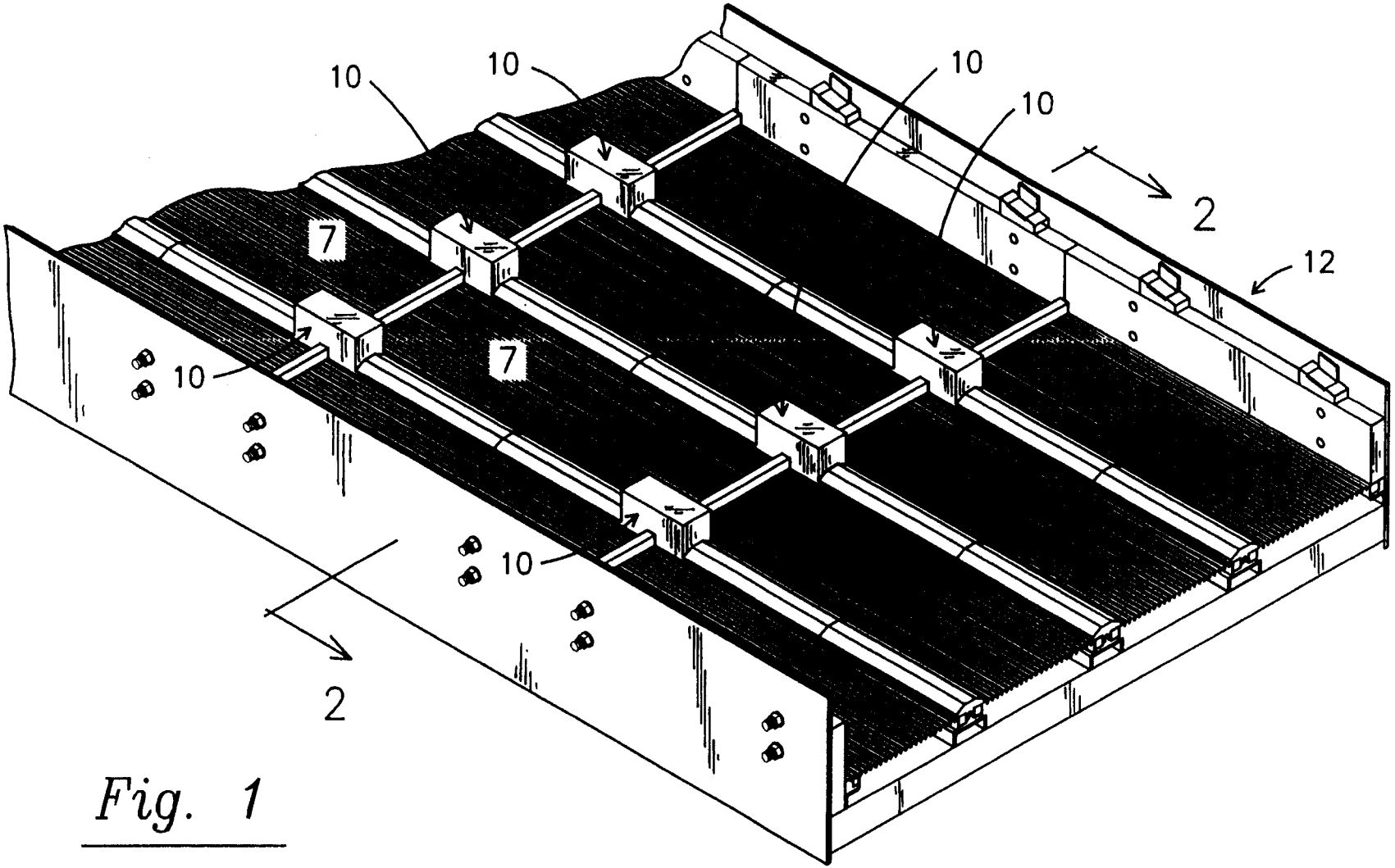
FIG. 1 is a perspective view of the invention illustrating its installation in a typical vibrating screen mechanism.
Figure 4:
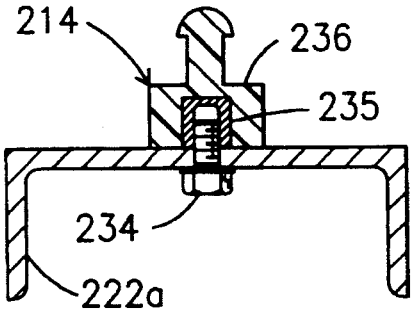
FIG. 4 is a cross sectional view of a second embodiment of the locking strip of the invention, illustrating attachment to the frame of a vibrating screen mechanism.
Figure 5:
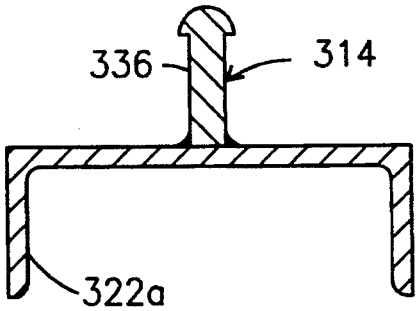
FIG. 5 is a cross sectional view of a third embodiment of the locking strip of the invention, illustrating attachment to the frame of a vibrating screen mechanism.
Figure 8:
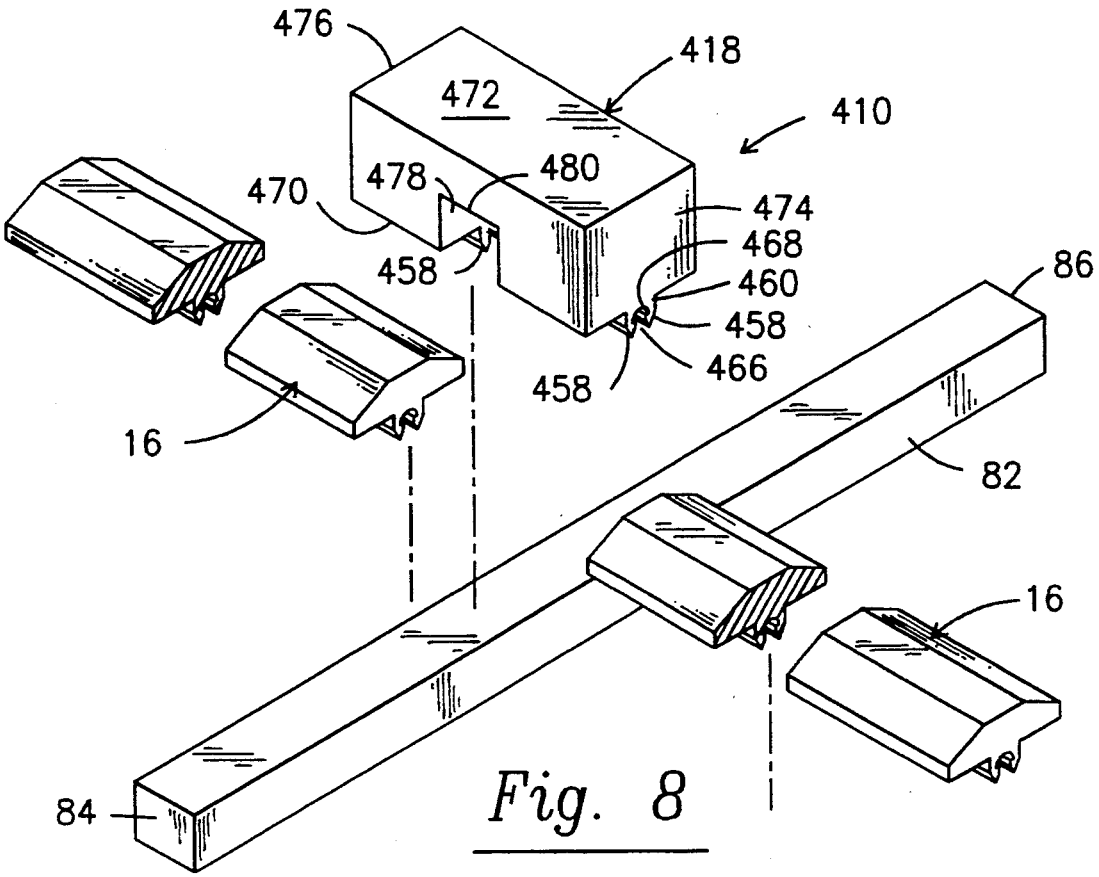
FIG. 8 is an exploded perspective view of a second embodiment of the wear pad and dam joint of this invention.

A preferred embodiment of the device of this invention is illustrated in the drawing FIGS. 1–3, 6, and 7, in which the device is generally indicated as 10. FIGS. 4, 5 and 8 illustrate different embodiments of portions of the invention and reference numbers are increased in increments of 100 to differentiate the different embodiments from one another. In FIG. 1, it can be seen that a plurality of the attaching devices 10 have been installed on a typical vibrating screen mechanism, shown generally as 12. As can be seen more clearly in FIG. 6, the attaching device 10 comprises an elongate locking strip, shown generally as 14, an elongate wear pad, shown generally as 16, and a dam joint, shown generally as 18.

Figure 2:
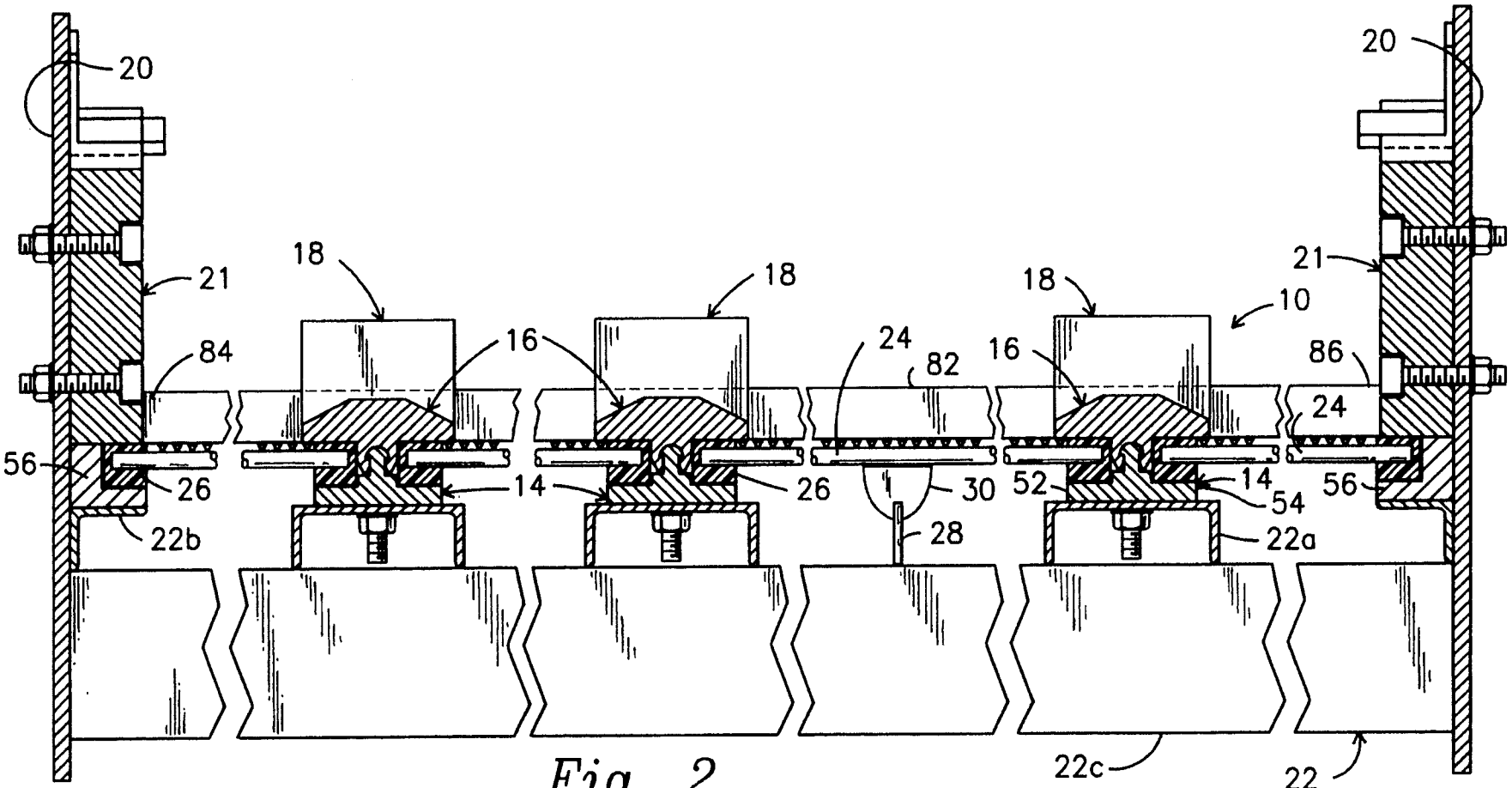
FIG. 2 is a partial cross sectional view taken along line 2—2 of FIG. 1.

FIGS. 1 and 2 illustrate the relationship of the attachment device 10 of this invention with the vibrating screen mechanism 12. The vibrating screen mechanism 12, which is well known in the art, is comprised of sides 20, side screen holding constructions, shown generally as 21, a frame, shown generally as 22, screen panels 24, with standard edging 26, and frequently a bucker bar 28 with a bucker strip 30 attached thereto. The frame 22 of a vibrating screen mechanism 12 may be configured in many ways; however, FIGS. 1 and 2 illustrate one of the common configurations that comprises C-channels **22*a*, support angles 22*b*, and cross beams 22*c*. With this type of frame 22 and similar frames, including but not limited to grids, the attaching device 10 may be attached directly to the existing frame 22, and in this embodiment directly to the C-channels 22*a*** as shown in FIGS. 1, 2, and 3.

Figure 3:
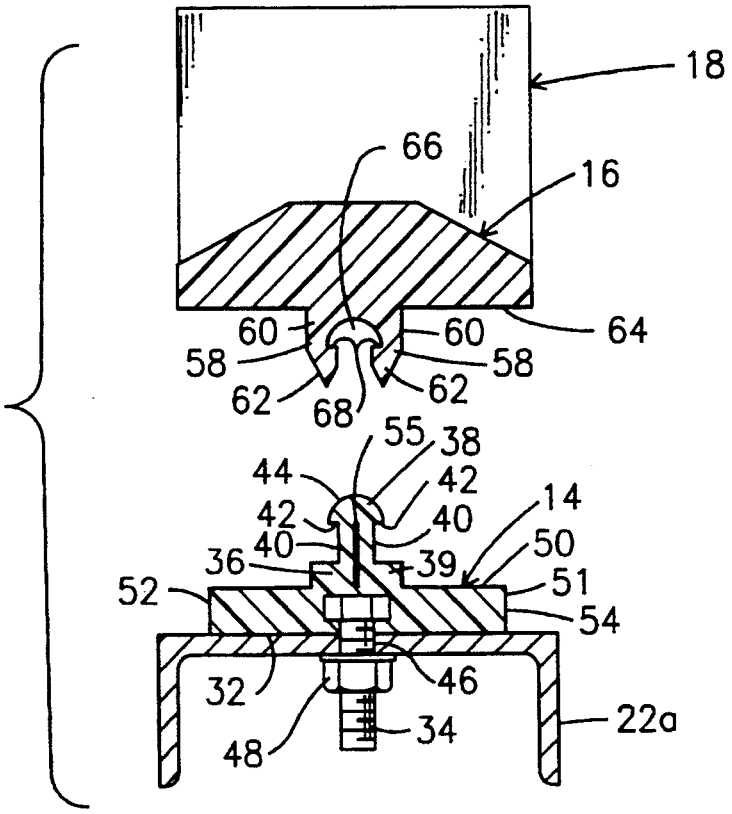
FIG. 3 is an enlarged cross sectional view of the invention as shown in FIG. 2, illustrating the wear pad separated from the locking strip.
Figure 6:
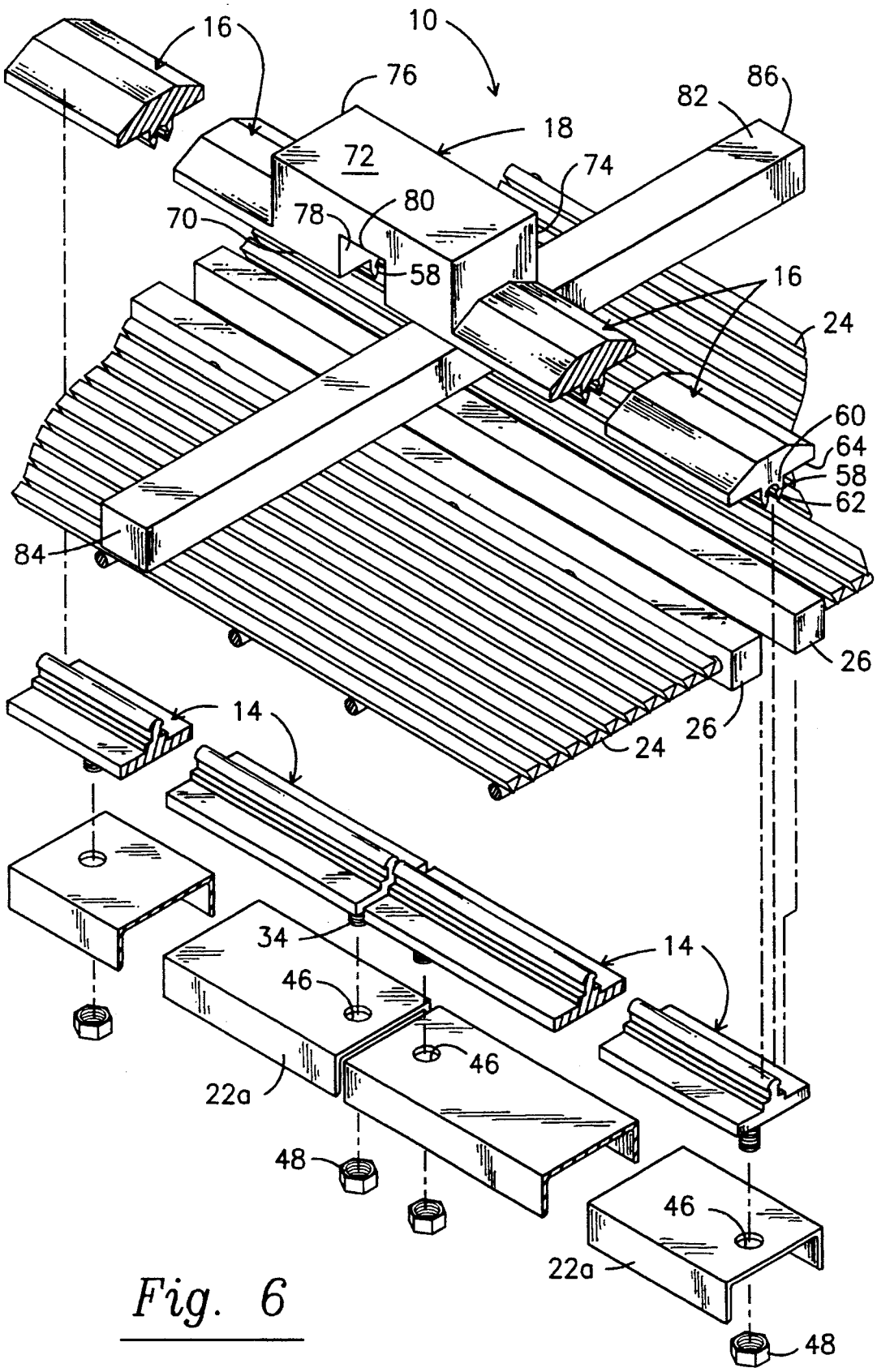
FIG. 6 is an enlarged, exploded, partial view of the invention as shown in FIG. 1.
Figure 7:
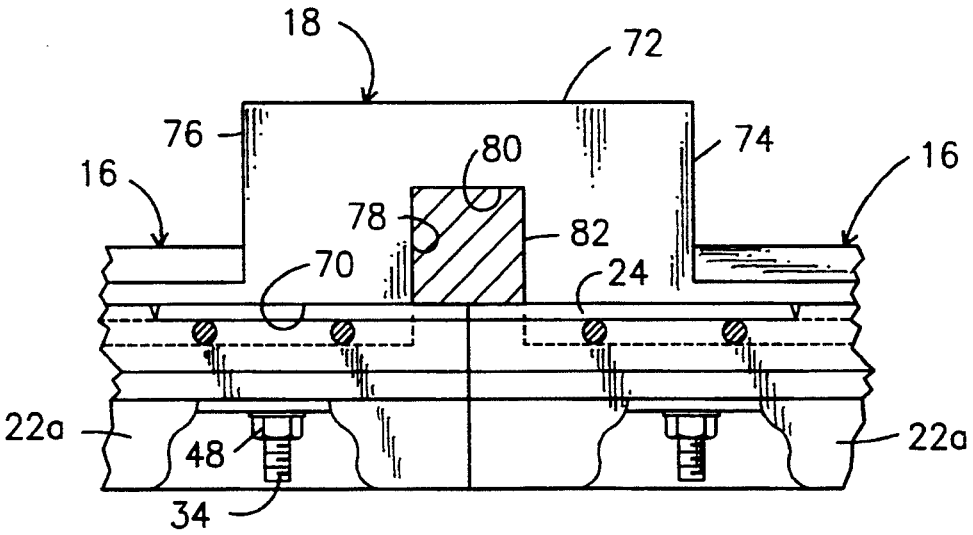
FIG. 7 is a cross sectional view of the invention taken along line 7—7 of FIG. 1.

As seen in FIG. 3, the locking strip 14 comprises a first surface 32, at least one bolt 34 attached to the locking strip 14 and extending from the first surface 32, and an elongate projection 36 that extends upwardly from the first surface 32 and, as best seen in FIG. 6, also extends longitudinally, generally the length of the locking strip 14. The projection 36 has an enlarged first end 38, an enlarged second end 39, and a pair of opposing sides 40. The first end 38 of projection 36 has two planar portions, conveniently a pair of shoulders 42, that extend at a generally right angles from each of the opposing sides 40 of the projection 36. The top surface 44 of the first end 38 of projection 36 is rounded to assist the reception of the projection 36 by a wear pad 16. In a preferred embodiment, a plurality of bolts 34 are formed in the locking strip 14 spaced apart from one another so that the bolts 34 can be inserted in respective existing apertures 46 of the existing C-channel **22*a*. Nuts 48 are then threadably engaged onto the bolts 34 for attachment of the locking strip 14 to the C-channels 22*a* of the vibrating screen mechanism 12. In other embodiments, such as shown in FIG. 4, the bolts 234 may be threadably received by a threaded insert 235 in the locking strip 214. In FIG. 5, a third embodiment illustrates the use of a locking strip 314 formed from metal which is welded to the C-channel 322*a***.

The locking strip 14 further comprises a second surface 50, a base 51 that is attached to the second end 39 of the projection 36 and extends laterally therefrom and also extends longitudinally generally the length of the locking strip 14. The base has a first edge 52 and a second edge 54. A portion of the periphery of each screen panel 24 (in a preferred embodiment this portion of the periphery has panel edging 26 thereon) rests on a portion of the second surface 50, as shown in FIG. 2. Standard panel edging 26, that is illustrated in the drawings, has generally straight edges and square corners that do not interlock with the attaching device 10.

The locking strip 14 further comprises a stiffener 55, as shown in FIG. 3, that comprises a metal bar or strip extending generally the length of the locking strip 14 and extending intermediate the first end 38 and second end 39 of the projection 36. This stiffener 55 strengthens the locking strip 14 to maintain improved contact with the C-channel **22*a* to which the locking strip 14 is attached. This strengthening becomes particularly important as the spacing between the attaching bolts 34** is increased.

FIGS. 4 and 5 illustrate other embodiments of the locking strip 14. In FIG. 4 the locking strip 214 does not include the base 51 with edges 52 and 54 that extend the second surface 50 outwardly from the projection 36, therefore the panel edging 26 of a screen panel 24 rests directly on the C-channel **222*a*. FIG. 5 illustrates a metal projection 336 that is also without the base 51 so that again, the panel edging 26 of the screen panels 24 rests directly on the frame 322*a***.

In the embodiment of the attaching device 10 illustrated in FIG. 2, the panel edging 26 of the screen panels 24 rests on the second surface 50 lifting the screen panel 24 above the C-channel **22*a*; therefore, to maintain the screen panels 24 in a generally horizontal orientation, transverse to the sides 20 of the vibrating screen mechanism 12, side filler strips 56 are inserted between the support angle 22*b* and the adjacent panel edging 26** resting thereon.

The elongate wear pad 16 comprises a pair of generally parallel, elongate and flexible elements 58 that extend generally the length of each pad 16. Each element 58 has a first end 60 and a second end 62. The first end 60 of each element 58 is attached to the first surface 64 of the pad 16 and each second end 62 extends generally outwardly from the first surface 64. A portion of each of the second ends 62 is angled toward one another defining a cavity 66 between the elements 58. In a preferred embodiment, the portions of the second ends 62 are angled inwardly toward one another at generally right angles to form a pair of elongate ledges 68. The cavity 66 is sized to receive the second end 38 of projection 36 therein so that each elongate shoulder 42 engages a corresponding elongate ledge 68 attaching the wear pad 16 to the locking strip 14. When the wear pad 16 is attached to locking strip 14, a portion of the periphery of the screen panels 24, comprising a portion of the panel edging 26, is captured intermediate the first surface 64 of the pad 16 and the C-channel 22*a*. In a preferred embodiment, illustrated in FIG. 2, it can be seen that a portion of the panel edging 26 is captured between the first surface 64 of the wear pads 16 and a portion of the second surface 50 of the locking strip 14. In the embodiments illustrated in FIG. 4 and 5, as mentioned earlier the panel edging 26 is captured between the first surface 64 of the pad 16 and the C-channel 22*a*.

In a preferred embodiment, as seen in FIG. 6, the attaching device 10 further comprises a dam joint 18 that has a first surface 70, a second surface 72, a first end 74 and a second end 76. The dam joint 18 comprises a pair of generally parallel, flexible and elongate dam joint elements 58 that extend outwardly from the first surface 70, and they extend generally the length of the dam joint 18. The dam joint elements 58 are configured generally the same as the elements 58 that are attached to the wear pads 16. At least one wear pad 16 is attached to or integrally joined with one of the ends 74 or 76 of the dam joint. In this embodiment as shown in FIG. 6, a wear pad 16 is integrally attached to end 74 and a second wear pad 16 is integrally attached to end 76 of the dam joint 18, so that the elements 58 of the wear pad 16 are aligned and integrally joined to the dam joint elements 58, creating a continuous pair of ledges 68. In a preferred embodiment as illustrated in FIG. 6, each wear pad 16, that is integrally joined to a dam joint 18, extends one half the corresponding dimension of the adjacent screen panels 24. This is done so that a pair of dam joints 18 with wear pads 16 attached provide complete coverage of the edge 26 of the adjacent panels 24. The dam joint 18 is attached, in the same fashion and generally simultaneously with the contiguously joined wear pads 16, to the locking strip 14.

The dam joint 18 has a slot 78 extending through the dam joint 18 transverse to the elements 58. The slot 78 extends from the second end 62 of the elements 58, through the elements 58 to a predetermined point 80 intermediate the first surface 70 and the second surface 72 of the dam joint 18. The slot 78 is sized and configured to receive a dam 82 therethrough. The dam 82 extends across a vibrating screen mechanism generally transverse to the longitudinal wear pads 16 and the dam joints 18. The first end 84 and the second end 86 of the dam 82 are attached to corresponding sides 20 of the vibrating screen mechanism 12. The method of attachment of the dam 82 is well known in the art and is not part of the invention defined herein.

Integrally joining the dam joint 18 to the wear pad 16 strengthens the attachment of the dam joint 18 to the locking strip 14. This allows the connection of the dam joint 18 to the locking strip 14 to withstand the forces applied to it by the dam 82 when materials that are being processed strike the dam 82. Joining the wear pad 16 to the dam joint 18 also reduces the number of parts necessary.

In other embodiments, as shown in FIG. 8, the dam joint 418 is formed separately from the wear pads 16 and is separately attached to the locking strip 14 adjacent to one wear pad 16 or between two wear pads 16. The dam joint 418 comprises a pair of generally parallel, flexible and elongate dam joint elements 458 that extend outwardly from the first surface 470, and they extend generally the length of the dam joint 418. The dam joint elements 458 are configured generally the same as the elements 58 that are attached to the wear pads 16 for attachment of the dam joint 418 to the locking strip 14.

In a preferred embodiment, the wear pad 16 is formed from a flexible elastomeric material, the locking strip 14 is formed from polyurethane, and the bolts and other metal parts are formed from steel. However, any material suitable for the purpose may be used as an alternative. In a third embodiment the locking strip 14 is comprised of steel or other material so that it may be easily welded to the C-channel 322*a* of the, vibrating screen device.

Having thus set forth a preferred construction for the attaching device 10 of this invention it is to be remembered that this is but a preferred embodiment. Attention is now invited to a description of the use of an attaching device 10. The attaching device 10 may be installed on both new and old vibrating screen mechanisms. The attaching device 10 is particularly adaptable for attachment to an existing screen mechanism 12, and the attaching device 10 is so illustrated in FIGS.1–8. In a typical vibrating screen mechanism 12 the screen panels 24 would have been attached to the screen mechanism 12 by bolting them to the existing C-channel 22*a*. Once all the old bolts are removed a locking strip 14, having bolts 34 spaced to match the existing apertures 46, is attached to the C-channel 22*a*. If the embodiment illustrated in FIGS. 1–3 is used, side filler strips 56 are attached to support angle 22*b* on each side 20 of the vibrating mechanism 12, so that the screen panels 24 are generally horizontal when placed between the base 51 of a locking strip 14 and the first surface 64 of the wear pad 16.

To provide extra support, bucker bars 28 with their attached bucker strip 30 are often attached to the cross beams 22*c* to support the midpoint of the panels 24. Bucker bars 28 are well known in the art. An enlarged bucker strip 30 may be required to compensate for the thickness of the base 51 of locking strip 14. The panel edging 26 of standard profile screen panels 24 are generally straight with square corners that do not engage the attaching device 10. The wear pad 16 is attached to the locking strip 14 by forcing the elements 58 over the top surface 44 of the projection 36 so that the enlarged first end 38 of the projection 36 is received in the cavity 66. Once the first end 38 of the projection 36 is received in the cavity 66 the ledge 68 of the element 58 engages the shoulder 42 of the projection 36 locking the wear pads 16 to the locking strip 14. When the embodiment of the attaching device 10 is used that has the wear pads 16 integrally attached to a dam joint 18, the dam joint 18 must be first located over an existing dam 82 so that the dam 82 is received in the slot 78. When the attaching device 410 is used, the dam joint 418 must first be located over the dam 482 and attached to the locking strip 14 before the wear pads 416 are attached.

The screen panels are now firmly attached to the vibrating screen mechanism 12, but may be quickly removed by prying up the wear pads 16 and the dam joint 18 avoiding the tedious task of removing the bolts and nuts required by the old method of attachment.

It will thus be seen that the objects set forth above among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for attaching portions of the periphery of a screening panel to a frame of a screening mechanism, said device comprising:

an elongate locking strip having a first surface, at least one bolt attached to and extending from said first surface of said locking strip, said bolt being attachable to a frame of a screening mechanism, and an elongate projection extending upwardly from said first surface of said locking strip and extending longitudinally generally the length of said locking strip, said projection having an enlarged first end and a second end; and an elongate wear pad having a first surface and having a pair of generally parallel, elongate, and flexible elements extending generally the length of said pad, each element having a first end attached to said pad and a second end extending generally outwardly from said first surface of said pad, said second ends of said elements being angled toward one another defining a cavity between said elements, and said elements receiving said enlarged first end of said projection therebetween such that said first end of said projection is received in said cavity, whereby a portion of a periphery of a screening panel adjacent said locking strip is captured intermediate said first surface of said pad and the frame.

2. A device as in claim 1 wherein said locking strip further comprises a second surface and a base attached to said second end of said projection such that said base extends laterally from said projection and extends longitudinally generally the length of said locking strip, said base having a first edge and a second edge, a portion of said periphery of a screening panel adjacent said locking strip being captured between said first surface of said pad and a portion of said second surface of said locking strip adjacent one of said first and second edges of said base of said locking strip.

3. A device as in claim 1 further comprising a dam joint, said dam joint having a first surface and a second surface, a pair of generally parallel, flexible, and elongate dam joint elements extending generally the length of said dam joint, each dam joint element having a first end attached to said first surface of said dam joint and a second end extending generally outwardly from said first surface of said dam joint, and a portion of said second ends of said dam joint elements being angled toward one another defining a dam joint cavity between said dam joint elements, said dam joint having a slot extending therethrough transverse to said dam joint elements and the depth of said slot extending from and through said dam joint elements to a predetermined point intermediate said first and said second surfaces of said dam n joint, said dam joint being attachable to said locking strip adjoining at least one said wear pad attached to said locking strip, said enlarged first end of said projection being received in said dam joint cavity between said dam joint elements, thereby attaching said dam joint to said locking strip, said slot sized and configured to receive a dam therein, such that a dam extending adjacent said screens and transverse to said locking strip is received in said slot.

4. A device as in claim 3 wherein said dam joint has at least one adjacent wear pad attached thereto extending generally one half the corresponding dimension of the screening panel.

5. A device as in claim 1 wherein said projection further comprises an elongated stiffener inserted therein extending intermediate said first end and said first surface of said locking strip and extending longitudinally generally the length of said locking strip.

6. A device for attaching portions of the periphery of a screening panel to a frame of a screening mechanism, said device comprising:

an elongate locking strip having a first surface, and an elongate projection extending upwardly from said first surface of said locking strip and extending longitudinally generally the length of said locking strip, said projection having a pair of opposing sides, an enlarged first end and a second end, said enlarged first end having a planar portion extending at a generally right angle from each said opposing sides of said projection forming a pair of elongate shoulders;

attaching means attaching said locking strip to a frame of a screening mechanism; and an elongate wear pad having a first surface and having a pair of generally parallel elongate elements extending generally the length of said pad, each element having a first end attached to said pad and a second end extending generally outwardly from said first surface of said pad, a portion of said second ends of said elements being angled at generally right angles toward one another forming an inwardly facing elongate ledge and defining a cavity between said elements, and said elements receiving said enlarged first end of said projection therebetween such that said first end of said projection is received in said cavity and said shoulder engages said ledge, whereby a portion of a periphery of a screening panel adjacent said locking strip is captured intermediate said first surface of said pad and the frame.

7. A device as in claim 6 further comprising a dam joint, said dam joint having a first surface and a second surface, said first surface having a pair of generally parallel, flexible, and elongate dam joint elements extending generally the length of said dam joint, each dam joint element having a first end attached to said first surface of said dam joint and a second end extending generally downwardly from said dam joint, and a portion of said second ends of said dam joint elements being angled toward one another at generally right angles forming an elongate dam joint ledge and defining a dam joint cavity between said dam joint elements, said dam joint having a slot extending therethrough transverse to said dam joint elements and the depth of said slot extending from and through said dam joint elements to a predetermined point intermediate said first and said second surfaces of said dam joint, said dam joint being attachable to said locking strip adjoining at least one said wear pad attached to said locking strip, said enlarged first end of said projection being received in said dam joint cavity between said dam joint elements such that said dam joint ledge of said dam joint engages said shoulder of said locking strip thereby attaching said dam joint to said locking strip, said slot sized and configured to receive a dam therein, whereby a dam extending adjacent slid screens and transverse to said locking strip is received in said slot.

8. A device as in claim 7 wherein said dam joint has at least one adjoining wear pad attached thereto.

9. A device as in claim 6 wherein said attaching means comprises at least one bolt attached to and extending from said first surface of said locking strip, said bolt being attachable to the frame of a screening mechanism.

10. A device as in claim 6 wherein said attachment means comprises welding said locking strip to the frame of a screening mechanism.

11. A device as in claim 6 wherein said projection further comprises an elongated stiffener inserted therein extending intermediate said first end and said first surface of said locking strip and extending longitudinally generally the length of said locking strip.

12. A device as in claim 6 wherein said locking strip further comprises a second surface, a base, a first edge, and a second edge, said base extending laterally outwardly beyond said projection such that a portion of said periphery of said screening panel adjacent said locking strip is captured between said first surface of said pad and a portion of said second surface of said locking strip adjacent one of said first and second edges of said locking strip.

* * * * *

UNITED STATES PATENT AND TRADEMARK OFFICE

CERTIFICATE OF CORRECTION

PATENT NO. : 5,361,911

DATED : November 8, 1994

INVENTOR(S) : Robert F. Waites, Sr.
Robert F. Waites, Jr.

It is certified that error appears in the above-identified patent and that said Letters Patent is hereby corrected as shown below:

Column 7, line 60, delete "n".

Column 8, line 67, delete "slid" and insert therefore —said—.

Signed and Sealed this

Seventeenth Day of January, 1995

*Attest:*

Bruce Lehman

BRUCE LEHMAN

*Attesting Officer*

*Commissioner of Patents and Trademarks*